US005507711A

United States Patent [19]

Richardson

[11] Patent Number: 5,507,711

[45] Date of Patent: Apr. 16, 1996

[54] LEG STRETCHER

[76] Inventor: Michael Richardson, 1129 Odom Dr., Fayetteville, N.C. 28304

[21] Appl. No.: 342,371

[22] Filed: Nov. 18, 1994

[51] Int. Cl.[6] ..... A63B 21/008

[52] U.S. Cl. ..... 482/112; 482/142; 482/907

[58] Field of Search ..... 482/111, 112, 482/142, 907

[56] References Cited

U.S. PATENT DOCUMENTS 4,531,730 7/1985 Chenera ..... 482/142

4,844,453 7/1989 Hestilow ..... 482/112

FOREIGN PATENT DOCUMENTS 1238771 6/1986 U.S.S.R. ..... 482/907

*Primary Examiner*—Lynne A. Reichard

*Attorney, Agent, or Firm*—John G. Mills and Associates

[57] ABSTRACT

This invention is a leg stretcher with a frame having a seat mounted thereon. A pair of leg platforms are hingedly mounted on opposite sides of the seat with removable hinge pins so that the platforms can be quickly connected and disconnected from the seat. A vertically disposed hydraulic jack is mounted on the frame below the seat. A vertically disposed lift beam is mounted on the hydraulic jack with rollers on the end thereof for engaging a block on the underside of each of the leg platforms so that as the jack raises the beam, the outer ends of the leg platforms will be raised toward a more horizontal position with smooth rolling contact between the wing blocks and the rollers. Elongated handles are connected at one end to the release valve and pump arm of the hydraulic jack with the other ends being disposed adjacent the seat so that the person using the leg stretcher can manipulate the hydraulic jack upwardly and downwardly while sitting on the seat.

4 Claims, 3 Drawing Sheets

LEG STRETCHER

FIELD OF INVENTION

This invention relates to physical fitness and more particularly means for stretching joints, muscles, tendons and ligaments.

1. Background of Invention

It is well known by people who exercise, and particularly by people who participate in strenuous exercise, that stretching relaxes muscles, prevents cramps and allows a person to limber up prior to engaging in the anticipated exercise.

Stretching exercises are not only desirable but necessary for top performance in the martial arts, ballet dancing and gymnastics as well as by physical therapists, athletes and others that want to become more flexible.

To accomplish the above, various exercising and stretching machines have been developed. A number of these systems include mechanical, electrical and even hydraulic adjusting means. These machines are invariably rather complicated, not smooth in operation, and cannot be compactly stored. These systems are not specifically designed to stretch the joints of the user as well as the leg tendons, ligaments and muscles.

2. Concise Explanation of Prior Art

U.S. Pat. No. 4,757,994 to Robert Chenera discloses a hinged platform that moves toward horizontal as the central portion thereof moves vertically downwardly. This disclosure also is specifically directed to a foot engaging attachment assembly and means for adjusting the same.

U.S. Pat. No. 4,844,453 to Gary P. Hestilow is considered of interest in that it discloses a stretching machine including a pair of leg bars and leg decks. A hydraulic cylinder is used as an activating means.

U.S. Pat No. 5,026,049 to John F. Goodman and U.S. Pat. No. 4,795,150 to Sven Harlan are both considered of interest in that they disclose some additional stretching apparatuses.

U.S. Pat. No. 4,531,730 to Robert Chenera is considered of interest in that it discloses a body stretching and exercising device that is mechanically lowered with wheels on the ends of the side platform to roll outwardly during downward manipulation.

U.S. Pat. No. 3,006,643 to Edgar F. Ryan and U.S. Pat. No. 3,761,081 to Clarence C. Simmons disclose additional exercising devices.

BRIEF DESCRIPTION OF INVENTION

After much research and study into the above mentioned problems, the present invention has been developed to provide a leg stretcher that is simple in construction and yet highly efficient in operation. It can also be used with both legs or it can isolate one leg. The present invention is specifically designed for the straddle stretch which is also referred to as the Chinese Split.

The present invention utilizes a single vertically operated hydraulic cylinder to move the leg platforms upwardly toward a horizontal position with the central seat remaining stationary.

The user of the present invention can stretch the hip joints initially followed by stretching of the leg ligaments, tendons and muscles. This is particularly advantageous in preparing for high kicks used in the martial arts.

Because of the structure of he present invention, slow release of the leg platforms can be realized with up and down movement being easily adjusted.

In view of the above it is an object of the present invention to provide a sturdy, stable platform for stretching.

Another object of the present invention is to provide a smoothly adjustable machine for straddle stretching.

Another object of the present invention is to provide a straddle stretching device that can be readily disassembled for compact storage.

Another object of the present invention is to provide a relatively simple and yet highly efficient stretching apparatus.

Another object of the present invention is to provide a means for stretching hip joints and leg ligaments, tendons, and muscles by providing a central seat having a fixed height with pivoted leg platforms whose outer ends move from a down position upwardly toward a horizontal position.

Another object of the present invention is to provide a central, vertically disposed hydraulic lift cylinder with smooth roller lift surfaces on the platforms of a leg stretcher.

Another object of the present invention is to provide a leg stretcher wherein the outer ends of a pair of platforms are pivoted from a central seat and can be smoothly lowered and raised by the user of the device.

Other objects and advantages of the present invention will become apparent and obvious from a study of the following description and the accompanying drawings which are merely illustrative of such invention.

DETAILED DESCRIPTION OF INVENTION

Figure 1:
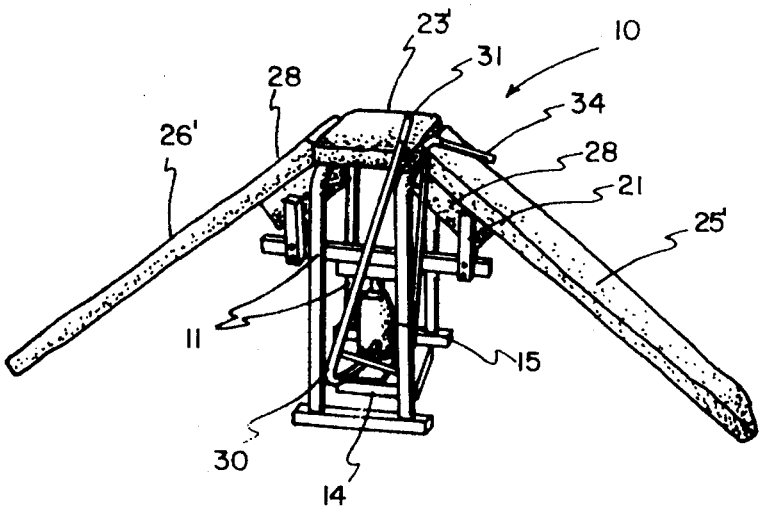
FIG. 1 is a perspective view of the leg stretcher of the present invention with the platforms in the lowered or down position.
Figure 2:
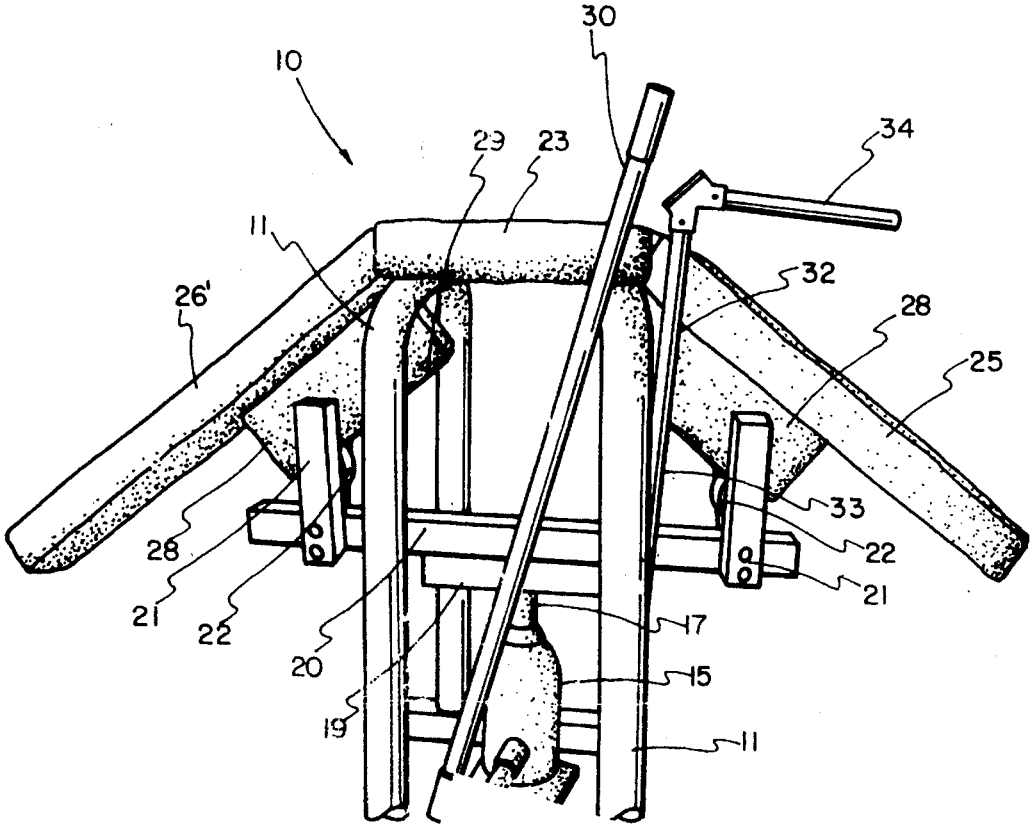
FIG. 2 is a enlarged perspective view of the platform lifting and lower means.

With further reference to the drawings, the leg stretcher of the present invention, indicated generally at 10, includes a pair of parallelly disposed, generally U-shaped frame members 11.

Front and rear cross frame members 12 connect the lower portion of frame members 11 while base frames 13 connect the cross frames 12.

A base plate 14 is mounted on base frames 13. A hydraulic jack type lift means 15 is mounted on base plate 14. This lift means includes a pump arm 16 which, when the end thereof is moved up and down, will cause the cylinder push rod 17 to move upwardly.

A rotatable release valve 18 is also provided in hydraulic lift 15 which, when closed, allows a push rod 17 to move upwardly when the pump arm 16 is manipulated. When the release valve is partially turned the push rod will move downwardly by the weight thereon. When the valve is rotated to the full open position, the push rod will retract relatively rapidly. Since hydraulic jack type lift means and their operation is well known to those skilled in the art, further detailed discussion of the same is not deemed necessary.

A lower lift beam 19 is mounted on the upper end of push rod 17. An upper lift beam 20 is bolted or otherwise secured to lower lift beam 19. A pair of upwardly disposed guides 21 are fixedly mounted on each end of the upper lift beam 20.

Mounted on the upper surface of upper lift beam 20, between each pair of guides 21, are lift rollers 22.

A seat 23 is bolted or otherwise secured to and extends between the upper surfaces of the parallelly disposed, generally U-shaped frame members 11. A plurality of separable hinges 24 are mounted on opposite sides of seat 23 and to the upper or inner ends of left and right leg platforms 25 and 26. A removable hinge pin 27 is provided for each of the separable hinges 24.

A support block 28 is mounted on the underside of each of the leg platforms 25 and 26. The lower surface of each of these support blocks 28 has a flat metal plate 29 that acts as a bearing surface for rollers 22 as will hereinafter be described in greater detail.

An upwardly extending arm 30 is connected at its lower end to release valve 18 and has a grip 31 on the opposite end which is disposed adjacent seat 23.

A Z-shaped pump handle 32 is slidingly mounted on a leg of one of the frame members 11 by guides or brackets 33. The lower end of pump handle 32 is operatively connected to pump arm 16 of hydraulic lift 15. The opposite end of handle 32 terminates in a grip 34.

The upper surface of seat 23 as well as the upper surface of the left and right hinged platforms 25 and 26 are padded or cushioned as indicated at 23', 25' and 26', respectively.

To assemble the leg stretcher 10 of the present invention, the left and right leg platforms 25 and 26 are connected by removable hinge pins 27 to opposite sides of seat 23 with the support blocks 28 being disposed between the pairs of guides 21 on opposite ends of upper lift beam 20. When in this position the metal bearing plates 29 on the bottom of the support blocks 28 will rest on the lift rollers 22 mounted on the upper lift beam 20 between the pairs of guides 21.

With the left leg and right leg platforms 25 and 26 of the leg stretcher 10 lowered to the position shown in FIG. 1, such stretcher is ready for use.

The user sits on the seat 23 with his or her legs resting on platforms 25 and 26 with the respective feet lying flat against the surface of respective platforms. The grip 31 is used to move the release valve control arm 30 to the position shown in FIG. 1 which closes the internal valve (not shown) in hydraulic lift 15. The grip 34 of pump handle 32 can be used to slidingly pump handle 32 up and down. Since the other end of this handle is operatively connected to the pump arm 16 of hydraulic lift 15, hydraulic fluid moved by the pumping action will cause the hydraulic push rod 17 to move upwardly. As this pump rod moves upwardly it carries with it the lower and upper lift beams 19 and 20 along with the associated guides 21 at opposite ends thereof. This in turn will raise the leg platforms 25 and 26 because of the contact between the bottom of support blocks 28 and the adjacent rollers 22. The platforms pivot about hinge pins 27 of seat to platform hinges 24.

Figure 3:
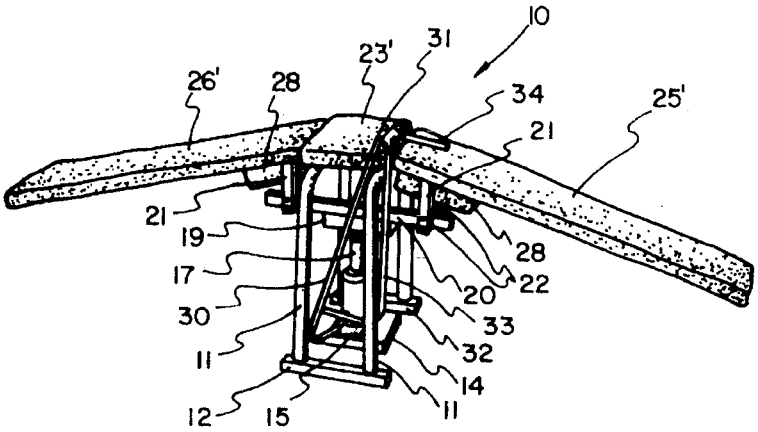
FIG. 3 is a perspective view of leg exerciser with the platforms partially raised.
Figure 4:
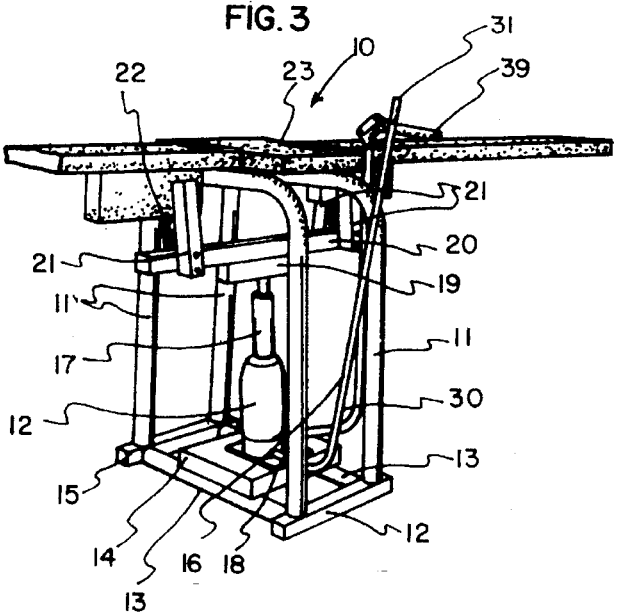
FIG. 4 is a partially cutaway perspective view of the leg stretcher with the platforms raised to a horizontal position.

It should be noted that the seat 23 remains stationary while the ends of the platforms 25 and 26 move upwardly from the lowered position shown in FIG. 1 to the elevated position shown in FIGS. 3 and 4.

When the desired amount of straddle stretch has been reached, by simply stopping pumping the grip 34, the upward movement of the platforms 25 and 26 will stop.

If it is desired to slowly drop the outer ends of platforms 25 and 26, the release valve control arm 30 is moved to the left (as oriented in the drawings) until the outer ends of such platforms begin to drop. This is caused by releasing hydraulic fluid (not shown) from the cylinder (not shown) operatively connected to the push rod 17.

When it is desired to stop the downward movement of the platforms, the release valve control arm 30 is simply moved back to the right (as oriented in drawings) to stop the push rod 17 from continuing to be pushed back into the hydraulic lift means 15.

If it is again desired to raise the ends of platforms 25 and 26, the grip 34 is simple again moved up and down to cause the push rod 17 to again move upwardly from the hydraulic lift 15.

When the straddle stretch exercising has been completed, the release valve control arm 30 is moved to its maximum travel to the left (as oriented in the drawings) to allow the platforms 25 and 26 to move downwardly to the starting position shown in FIG. 1.

Figure 5:
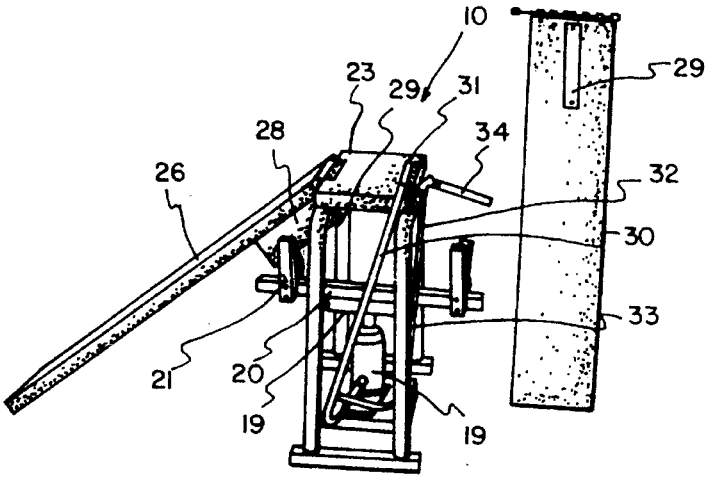
FIG. 5 is a perspective view of the leg stretcher with one of the platforms removed.
Figure 6:
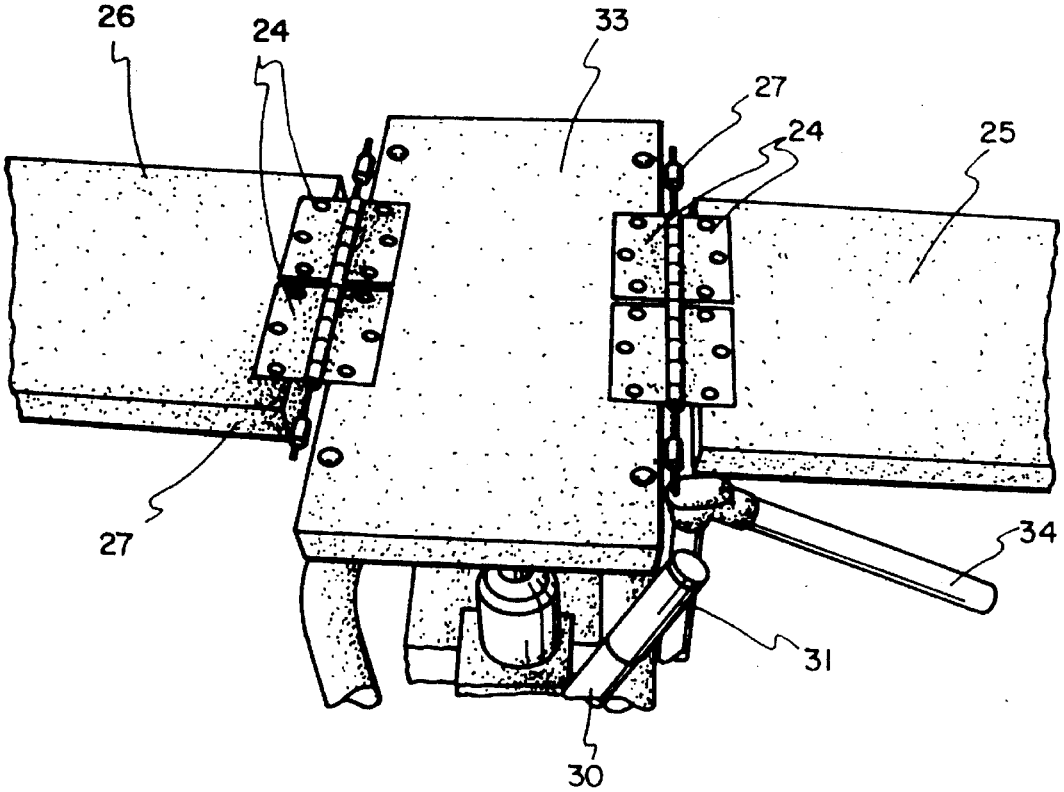
FIG. 6 is an enlarged perspective view of the hinge connections between the seat and the leg platforms.

If it is desired to stretch only one leg, the opposite platform can be removed by simply pulling the respective hinge pin 27 from the associated hinge 24 and lifting the platform out of engagement with seat 23 and guides 21 as clearly shown in FIG. 5.

Whenever it is desired to compactly store the leg stretcher of the present invention, both of the leg platforms 25 and 26 are removed from engagement with seat 23 and pairs of guides 21 by simply pulling both hinge pins.

To reassemble the leg stretcher of the present invention for use, the leg platforms are simply again attached to seat 23 by aligning the hinge parts and pushing the hinge pins into place with the support blocks 28 being disposed between the respective pairs of guides 21 on upper lift beam 20.

From the above it can be seen that the present invention provides a relatively simple and yet highly efficient means for straddle stretching as well as other stretching exercises. The up and down movement of the leg platform is also readily controlled. Either of the leg platforms can be removed when it is desired to exercise only one leg and both platforms can be removed for compact storage of the leg stretcher when not in use.

What is claimed is:

1. A leg stretcher comprising:

a frame means that supports an elevated seat means;

a pair of leg platforms hingedly mounted on opposite sides of said seat means;

a generally vertically disposed hydraulic lift means mounted on said frame means below said seat means, said hydraulic lift means including at least one generally horizontally disposed, lift beam mounted thereon for engagement with an underside of each of said leg platforms, said lift beam including rollers mounted on opposite ends thereof for rolling engagement with said underside of said leg platforms, said lift beam further including guides beams fixedly attached on opposite thereof adjacent said rollers for guiding the rolling engagement between said rollers and said leg platforms whereby when said lift means is extended, the outer ends of said leg platforms opposite the hinged connection with said seat means will be raised and when said lift means is lowered, said outer ends of said leg platforms opposite their connection to said seat means will be lowered.

2. The leg stretcher of claim 1 wherein control means are provided adjacent said seat means for controlling the up and down movement of said lift means.

3. The lift means of claim 2 wherein said control means is a pump operating handle and a release valve handle operatively connected to said hydraulic lift means.

4. The leg stretcher of claim 1 wherein removable hinge pins are provided on each of said pair of leg platforms at said hinged connection with said seat means whereby said platforms can be readily removed from said seat means.

* * * * *